US009063456B2

(12) United States Patent
Gutierrez et al.

(10) Patent No.: US 9,063,456 B2
(45) Date of Patent: Jun. 23, 2015

(54) SEAL CONFIGURATIONS FOR IMAGE FORMING APPARATUS

(75) Inventors: Carlos Gutierrez, San Fernando, CA (US); Jesus Gonzalez, Chatsworth, CA (US)

(73) Assignee: CLOVER TECHNOLOGIES GROUP, LLC, Ottawa, IL (US)

( * ) Notice: Subject to any disclaimer, the term of this patent is extended or adjusted under 35 U.S.C. 154(b) by 170 days.

(21) Appl. No.: 13/491,215

(22) Filed: Jun. 7, 2012

(65) Prior Publication Data

US 2013/0330099 A1 Dec. 12, 2013

(51) Int. Cl.
*G03G 15/08* (2006.01)

(52) U.S. Cl.
CPC ..... *G03G 15/08* (2013.01); *G03G 15/0817* (2013.01)

(58) Field of Classification Search
CPC ..... G03G 15/0817
USPC ..... 399/103, 109
See application file for complete search history.

(56) References Cited

U.S. PATENT DOCUMENTS

| | | | | |
|---|---|---|---|---|
| 6,574,445 | B2 * | 6/2003 | Higeta et al. | 399/103 |
| 6,577,829 | B2 * | 6/2003 | Higeta et al. | 399/109 |
| 6,643,481 | B2 * | 11/2003 | Higeta et al. | 399/109 |
| 6,980,752 | B2 * | 12/2005 | Kamimura | 399/103 |
| 7,352,981 | B2 * | 4/2008 | Fuwazaki et al. | 399/103 |
| 2009/0035011 | A1 * | 2/2009 | Delcamp et al. | 399/106 |

* cited by examiner

*Primary Examiner* — Sandra Brase

(57) ABSTRACT

A device is disclosed. The device contains a roller, a housing configured to accommodate the roller, at least one seal comprising a first material, wherein the at least one seal is disposed between the roller and the housing, and at least one second material disposed adjacent to the seal.

7 Claims, 11 Drawing Sheets

SEAL CONFIGURATIONS FOR IMAGE FORMING APPARATUS

FIELD

The present invention relates generally to the field of toner cartridges.

BACKGROUND

FIG. 1 depicts a cross-sectional view of the image forming apparatus 100 know in the art. The image forming apparatus 100 may be color and/or black-and-white copiers, color and/or black-and-white printers, and/or so-called "all-in-one devices" that incorporate two or more functions such as scanning, copying, printing, and faxing capabilities in one device.

Referring to FIG. 1, a photosensitive drum 1 on which a latent image may be formed may be rotated in the direction of arrow A, and may be uniformly charged by a charging apparatus 2 for charging the photosensitive drum 1, and an electrostatic latent image is formed on the surface thereof by a laser beam 3 from an exposing unit for writing the electrostatic latent image on the photosensitive drum 1. This electrostatic latent image may be developed and visualized as a toner image by a developing assembly 4 disposed in proximity to the photosensitive drum 1. The developing assembly 4 is further described in more detail below with reference to FIG. 2.

As known in the art, the visualized toner image on the photosensitive drum 1 may be transferred to paper 13 which is a recording medium by a transferring roller 9. Any residual toner left on the photosensitive drum 1 may be scraped off by a cleaning blade 10 and contained in a waste toner containing container 11. On the other hand, the paper 13 to which the toner image has been transferred is subjected to the fixing process by a fixing apparatus 12 and is discharged out of the apparatus and thus completing the printing operation.

The developing assembly 4 will be further described next with reference to FIG. 2. In FIG. 2, the reference numeral 14 designates a developing container as the developer container containing therein a magnetic/non-magnetic toner/developer 8.

The developing assembly 4 may be provided with a developing roller 5 as the developer carrying member located in an opening portion of the developing container 14 and disposed in opposed relationship with the photosensitive drum 1, and is adapted to develop and visualize the electrostatic latent image on the photosensitive drum 1. The developing roller 5 may be in contact with the photosensitive drum 1.

The specific developing operation is such that the magnetic/non-magnetic toner/developer 8 in the developing container 14 is sent toward a roller 6 with the rotation of an agitating member 16 in the direction of arrow C. In one exemplary embodiment, the roller 6 may be an elastic roller. In another exemplary embodiment, the roller 6 may referred to as a toner adder roller. Next, by the elastic roller 6 being rotated in the direction of arrow D, the toner/developer 8 is carried to the vicinity of the developing roller 5, and in the contact portion between the developing roller 5 and the elastic roller 6, the developer 8 carried on the elastic roller 6 frictionally contacts with the developing roller 5 and is thereby subjected to frictional charging, and adheres onto the developing roller 5. Thereafter, with the rotation of the developing roller 5 in the direction of arrow B, the toner 8 is sent under the pressure contact of a blade 7, and is formed into a thin layer on the developing roller 5. In one exemplary embodiment, the blade 7 may be an elastic blade. In another exemplary embodiment, the blade 7 may referred to as a regulating member or a doctor blade. The layer of the magnetic/non-magnetic toner 8 formed as the thin layer on the developing roller 5 is uniformly carried to a developing portion which is a portion opposed to the photosensitive drum 1. In this developing portion, the layer of the toner 8 formed as the thin layer on the developing roller 5 develops the electrostatic latent image on the photosensitive drum 1 as a toner image by a DC voltage applied to the developing roller 5.

Any un-developed toner 8 not consumed in the developing portion is collected from the lower portion of the developing roller 5 with the rotation of the developing roller 5. A seal member 17 comprising a flexible sheet (sealing blade) is provided in this collecting portion and permits the passage of the undeveloped toner into the developing container 14 and also prevents the magnetic/non-magnetic toner 8 in the developing container 14 from leaking from the lower portion of the developing roller 5. The seal member 17 is shown in FIG. 1. This collected undeveloped toner on the developing roller 5 is scraped off from the surface of the developing roller 5 in the contact portion between the elastic roller 6 and the developing roller 5 and at the same time, fresh toner is supplied onto the developing roller 5 by the rotation of the elastic roller 6, and the aforedescribed action is repeated.

In order to prevent the leakage of the toner 8 from the vicinity of the end portions of the developing roller 5 to the outside, i.e., the so-called toner leakage, end portion seal members 19 as the seal members are discretely provided near the end portions of the developing roller 5. One of the end portion seal members 19 is shown with doted lines in FIG. 1 and solid lines in FIG. 2.

FIG. 3 shows the front structure of the developing assembly 4 shown in FIGS. 1-2. FIG. 3 is a view of the developing assembly 4 as it is seen in the direction from the photosensitive drum 1. For ease of reference, the developing roller 5 is not shown in FIG. 3. FIG. 4 shows the front structure of the developing assembly 4 with the developing roller 5. The side surface portions of the end portion seal members 19 are disposed so as to contact with the opposite end surface portions of the elastic blade 7 and the surface of the developing roller 5 to thereby prevent the leakage of the toner 8 from the opposite end portions of the elastic blade 7 and the developing roller 5. As the developing roller 5 rotates in the direction of arrow B, the surface of the developing roller 5 is in frictional contact with the end portion seal members 19 to prevent the leakage of the toner 8. As known in the art, the end portion seal members 19 may comprise a fibrous material such as woolen felt or PTFE pile, or a foamed material such as polyurethane foam, or sponge rubber, or molded silicone.

Throughout the operational life of the developing assembly 4, the developing roller 5 rotates thousands of times which results in formation of gaps between the developing roller 5 and the end portion seal members 19 and leakage of the toner 8. In view of this problem, a need exists for a process and associated apparatus to reduce leakage of the toner 8.

SUMMARY

According to a first aspect of the present disclosure, a device is disclosed, the device comprising: a roller; a housing configured to accommodate the roller; at least one seal comprising a first material, wherein the at least one seal is disposed between the roller and the housing; and at least one second material disposed adjacent to the seal.

According to a second aspect of the present disclosure, a method is disclosed, the method comprising: providing a housing; providing a toner within the housing; installing at least one material within the housing; installing at least one seal member within the housing; and installing a roller within the housing, wherein the at least one material is configured to minimize leakage of the toner between the at least one seal and the roller.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1:
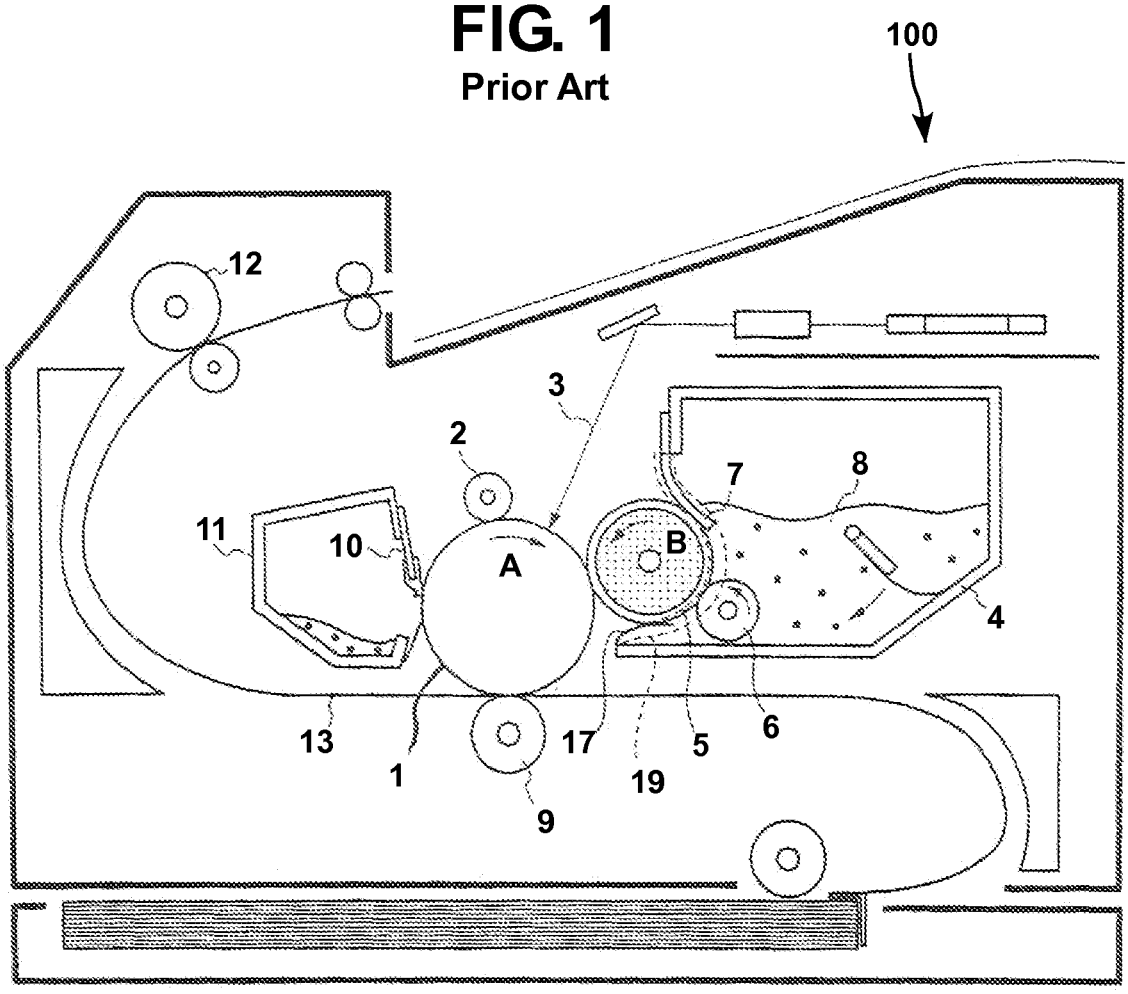
FIG. 1 Prior Art
FIG. 1 depicts a cross-sectional view of an image forming apparatus known in the art.
Figure 2:
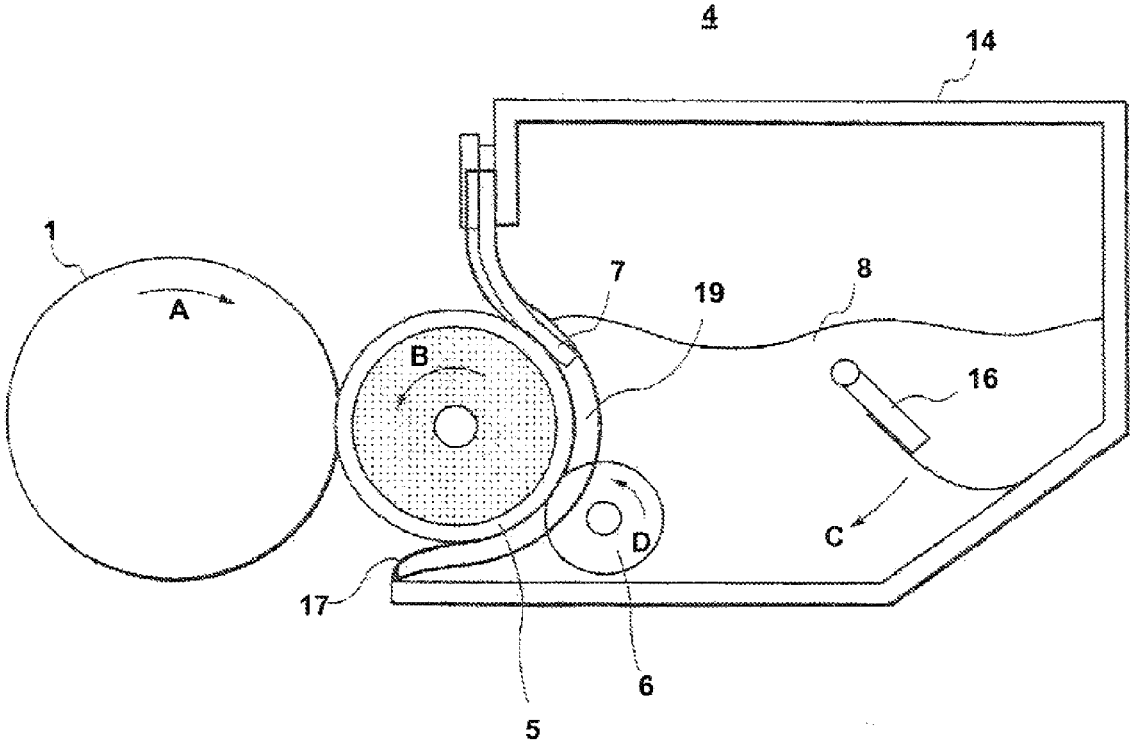
FIG. 2 Prior Art
FIG. 2 depicts a cross-sectional view of the developing assembly shown in FIG. 1.
Figure 3:
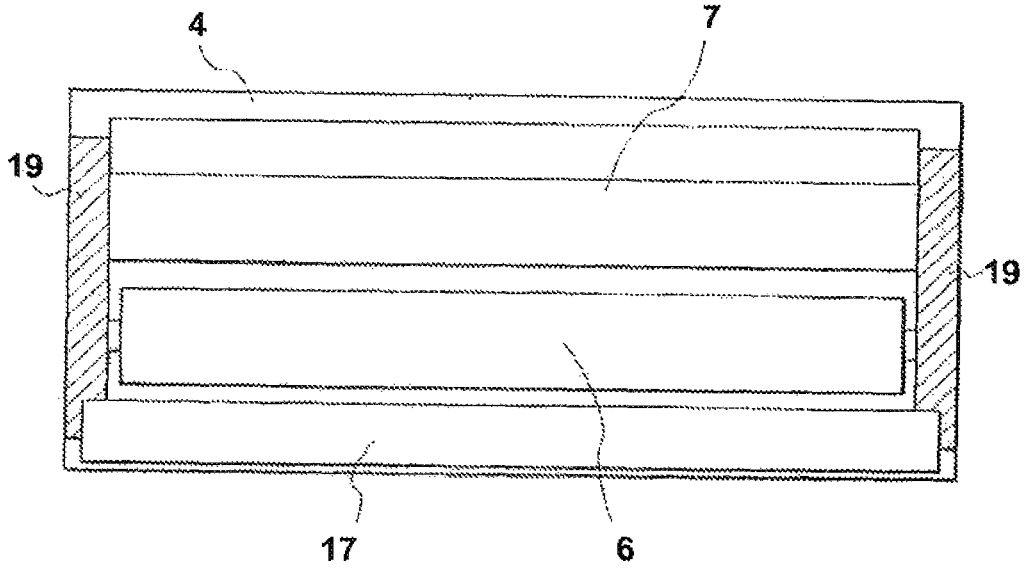
FIG. 3 Prior Art
FIGS. 3-4 depict the front view of the developing assembly shown in FIG. 1.
Figure 4:
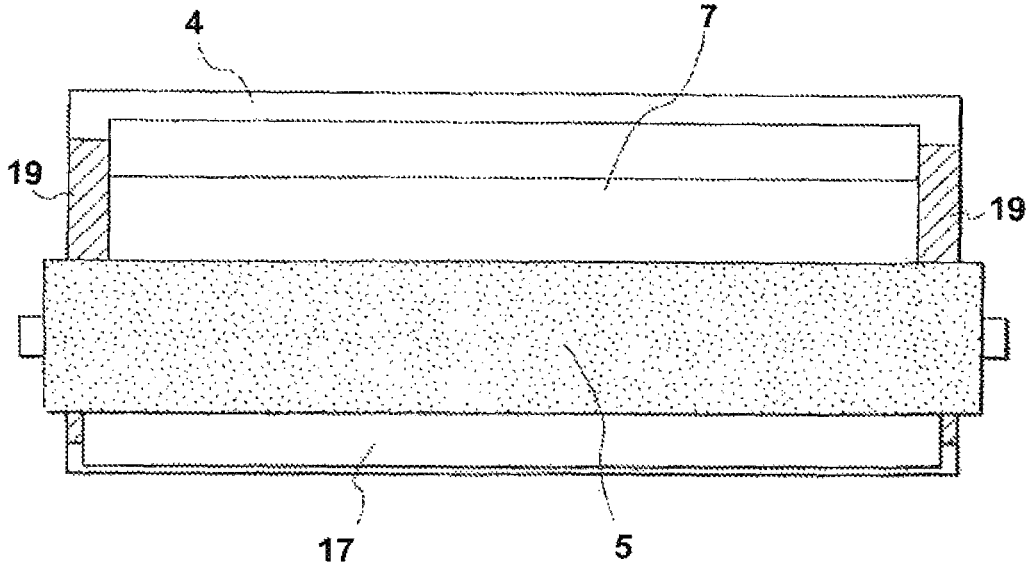
FIG. 4 Prior Art
Figure 5:
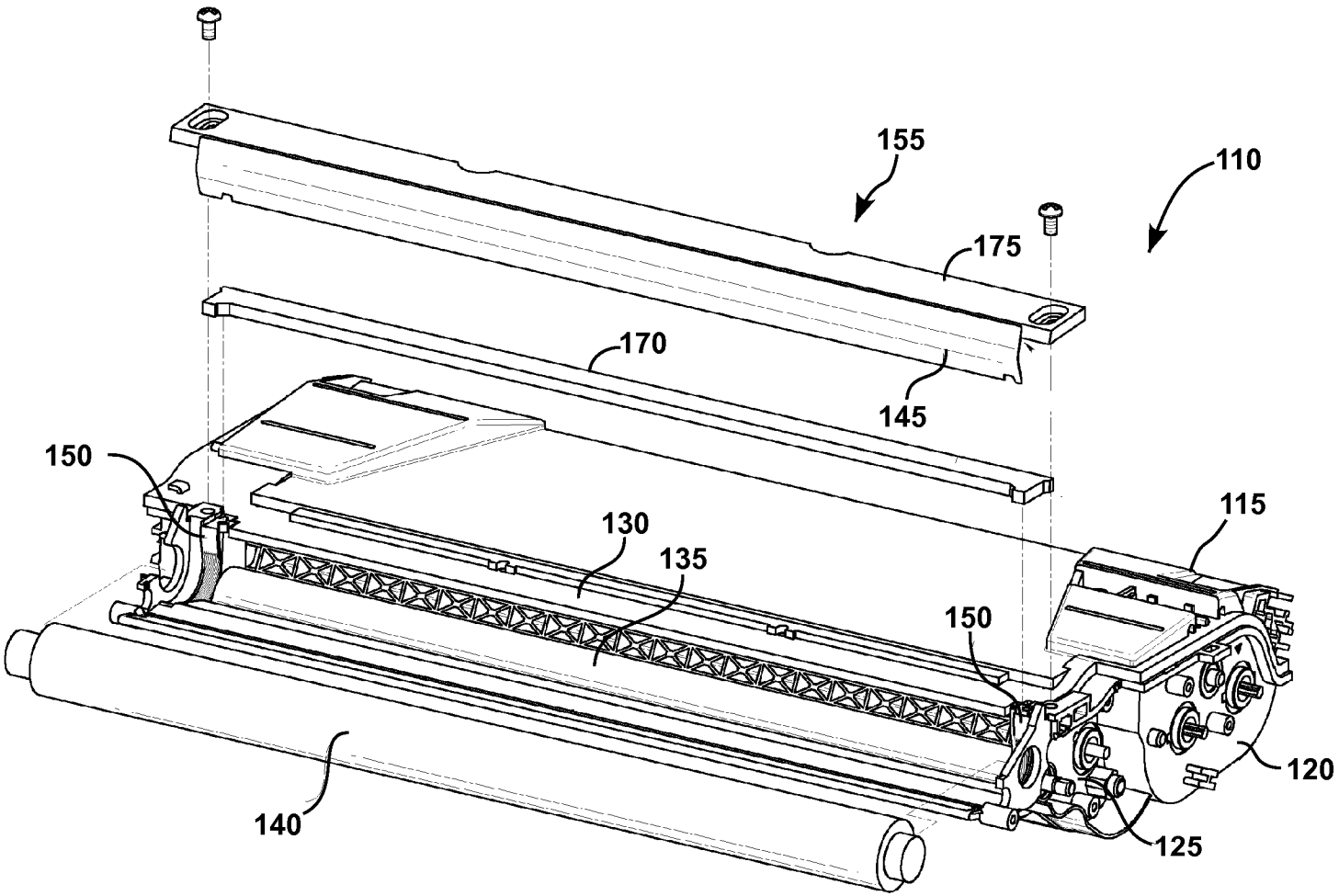
FIG. 5 Prior Art
FIG. 5 depicts partially exploded perspective view of a developer assembly known in the art.

Referring now to FIG. 5, a developer assembly 110 as known in the art is depicted in perspective view. The developer assembly 110 comprises a housing 115, formed of a first housing portion 120 and a second housing portion 125. Along at least one side of the housing 115 is a lid 130. Within the first housing portion 120, a plurality of toner is stored, and at least one paddle is located therein on a rotating shaft to move the toner from the first housing portion 120 toward the second housing portion 125. A toner adder roll 135 is located within or adjacent to the second housing portion 125, and receives toner therefrom. The toner adder roll 135 coats the developing roller 140 with toner, which is scraped or "doctored" by the doctor blade 145 to form an even layer of toner on the surface of the developing roller 140, that in turn supplies toner to the imaging or photoreceptive drum (not shown).

Figure 6:
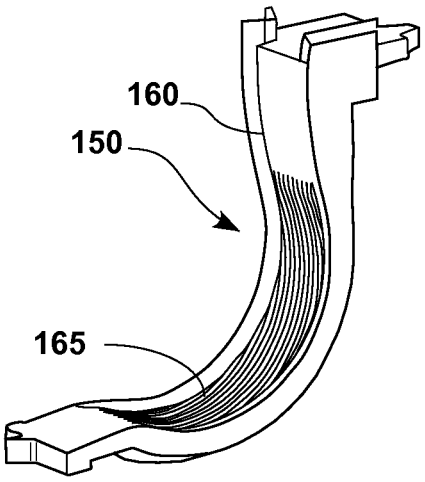
FIG. 6 Prior Art
FIG. 6 depicts a j-shaped seal known in the art.

The developer assembly 110 comprises seals 150 at ends of the developing roller 140. The developing roller 140 is exploded for clarity, so that the seals 150 may be seen. In one exemplary embodiment, the seals 150 may be substantially j-shaped to receive the doctor blade assembly 155 near the top and developing roller 140 near the bottom as shown in FIG. 6. Referring to FIG. 6, the upper portion 160 of the j-seal 150 is slightly curved to substantially match the deflected shape of the doctor blade 145 while the lower portion 165 of the j-seal 150 is curved to slidably receive the developing roller 140. It is to be understood that other curvilinear shapes may also be utilized to implement seals 150.

Referring to FIG. 5, disposed above the seals 150 is a doctor blade seal 170, which extends in a length that is parallel to the axial dimension of both the toner adder roll 135 and the developing roller 140. Also disposed above the seals 150 is a doctor blade bracket assembly 155 comprising at least one bracket 175 and a doctor blade 145. Like the doctor blade seal 170, the doctor blade bracket assembly 155 also extends in a direction which is substantially parallel to the axial dimension of both the toner adder roll 135 and developing roller 140. The doctor blade seal 170 is captured between the doctor blade bracket assembly 155 and either the j-seal 150 or the lid 130. The doctor blade 145 engages the developing roller 140 to scrape excess toner from the surface of the developing roller 140, which provides a consistent level of toner to the imaging or photoreceptive drum of the printer (not shown). The doctor blade seal 170 is seated on the j-seals 150 to inhibit leakage of toner near ends of the developer roll and between the lid 130 and the developer housing 115. The doctor blade bracket assembly 155 compresses the doctor blade seal 170 to improve sealing in this area.

Figure 7A:
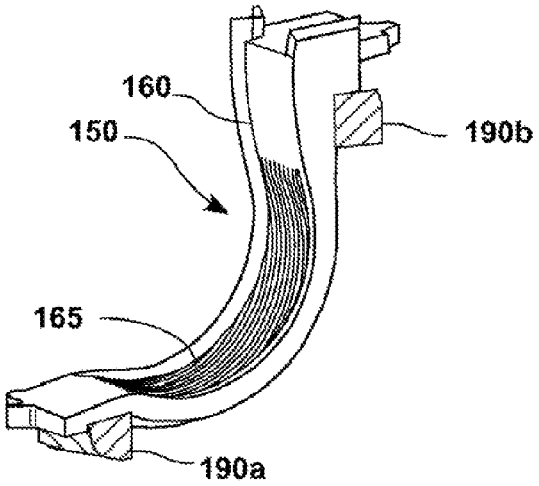
FIGS. 7*a-d* depict exemplary materials according to the present application.

In an effort to minimize leakage of toner between the seal(s) 150 and the developing roller 140, in one exemplary embodiment according to the present applications, materials 190*a-b* may be placed under the seal(s) 150, as shown in FIG. 7*a*, to raise at least a portion of the seal(s) 150 above the housing 115 and to provide tighter fit between the seal(s) 150 and the developing roller 140.

Figure 7B:
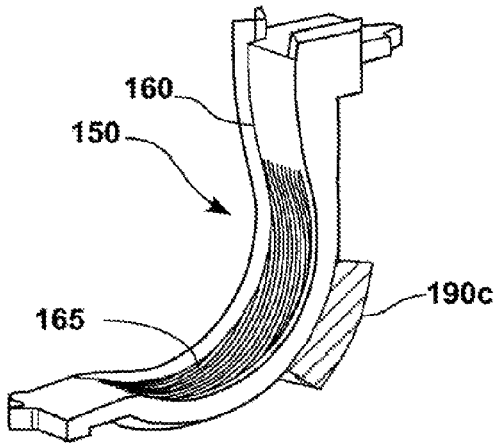

In another exemplary embodiment, a material 190*c* may be placed under the seal(s) 150, as shown in FIG. 7*b*, to raise at least a portion of the seal(s) 150 above the housing 115 and to provide tighter fit between the seal(s) 150 and the developing roller 140.

Figure 7C:
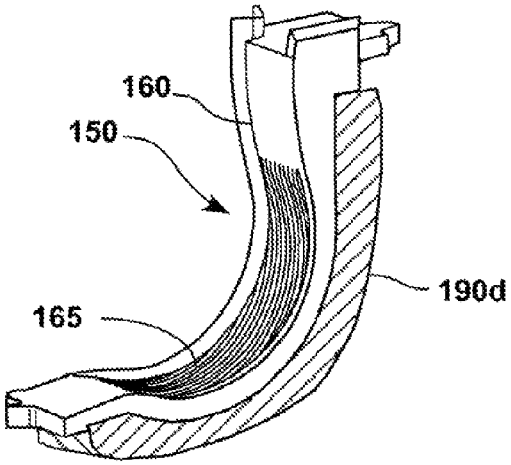

In another exemplary embodiment, a material 190*d* may be placed under the seal(s) 150, as shown in FIG. 7*c*, to raise at least a portion of the seal(s) 150 above the housing 115 and to provide tighter fit between the seal(s) 150 and the developing roller 140.

Figure 7D:
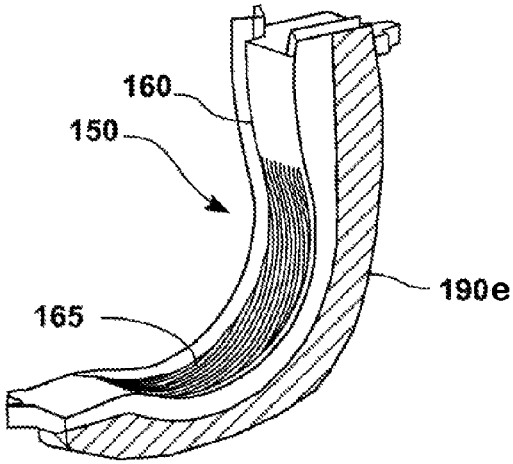

In another exemplary embodiment, a material 190*e* may be placed under the seal(s) 150, as shown in FIG. 7*d*, to raise the seal(s) 150 above the housing 115 and to provide tighter fit between the seal(s) 150 and the developing roller 140.

Figure 8A:
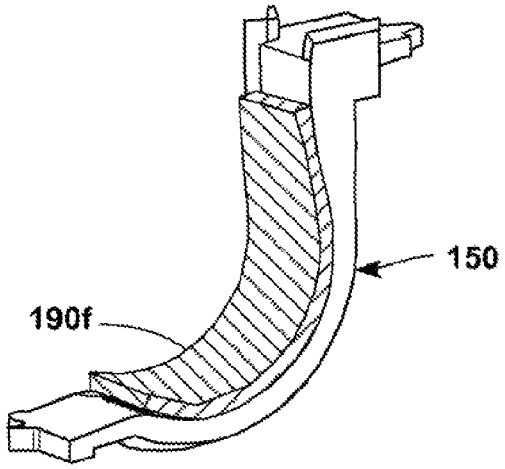
FIGS. 8*a-d* depict additional exemplary materials according to the present application.

In an effort to minimize leakage of toner between the seal(s) 150 and the developing roller 140, in one exemplary embodiment according to the present applications, a material 190*f* may be placed above the seal(s) 150, as shown in FIG. 8*a*, to provide tighter fit between at least a portion of the material 190*f* and the developing roller 140.

Figure 8B:
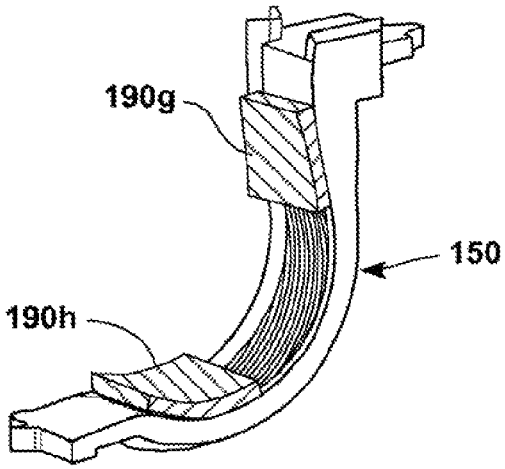

In another exemplary embodiment, materials 190*g-h* may be placed above the seal(s) 150, as shown in FIG. 8*b*, to provide tighter fit between the materials 190*g-h* and the developing roller 140.

Figure 8C:
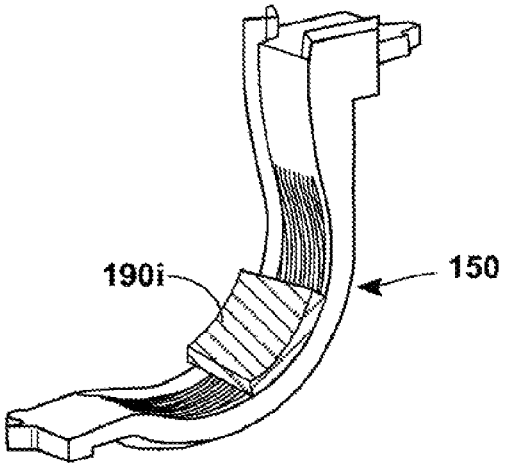

In another exemplary embodiment, a material 190*i* may be placed above the seal(s) 150, as shown in FIG. 8*c*, to provide tighter fit between the material 190*i* and the developing roller 140.

Figure 8D:
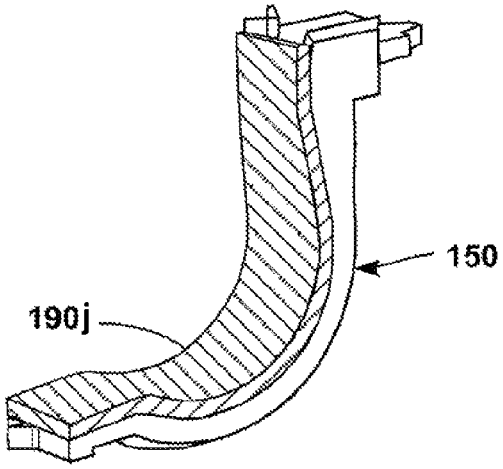

In another exemplary embodiment, a material 190*j* may be placed above the seal(s) 150, as shown in FIG. 8*d*, to provide tighter fit between the material 190*j* and the developing roller 140.

In one exemplary embodiment according to the present application, the materials 190*a-e* may be inserted between the seal(s) 150 and the housing 115 during remanufacturing of the developer assembly 110. In one exemplary embodiment according to the present application, the materials 190*a-e* may be inserted between the seal(s) 150 and the housing 115 during original manufacturing of the developer assembly 110.

In one exemplary embodiment according to the present application, the materials 190*f-j* may be placed above the seal(s) 150 during remanufacturing of the developer assembly 110. In one exemplary embodiment according to the present application, the materials 190*f-j* may be placed above the seal(s) 150 during original manufacturing of the developer assembly 110.

The materials 190*a-j* may comprise woolen felt or PTFE pile, polymeric material, metal, silicone or a foamed material such as polyurethane foam or sponge rubber.

Figure 9A:
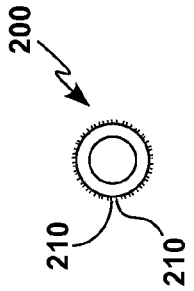
FIGS. 9*a-c* depict additional exemplary materials according to the present application.
Figure 9B:
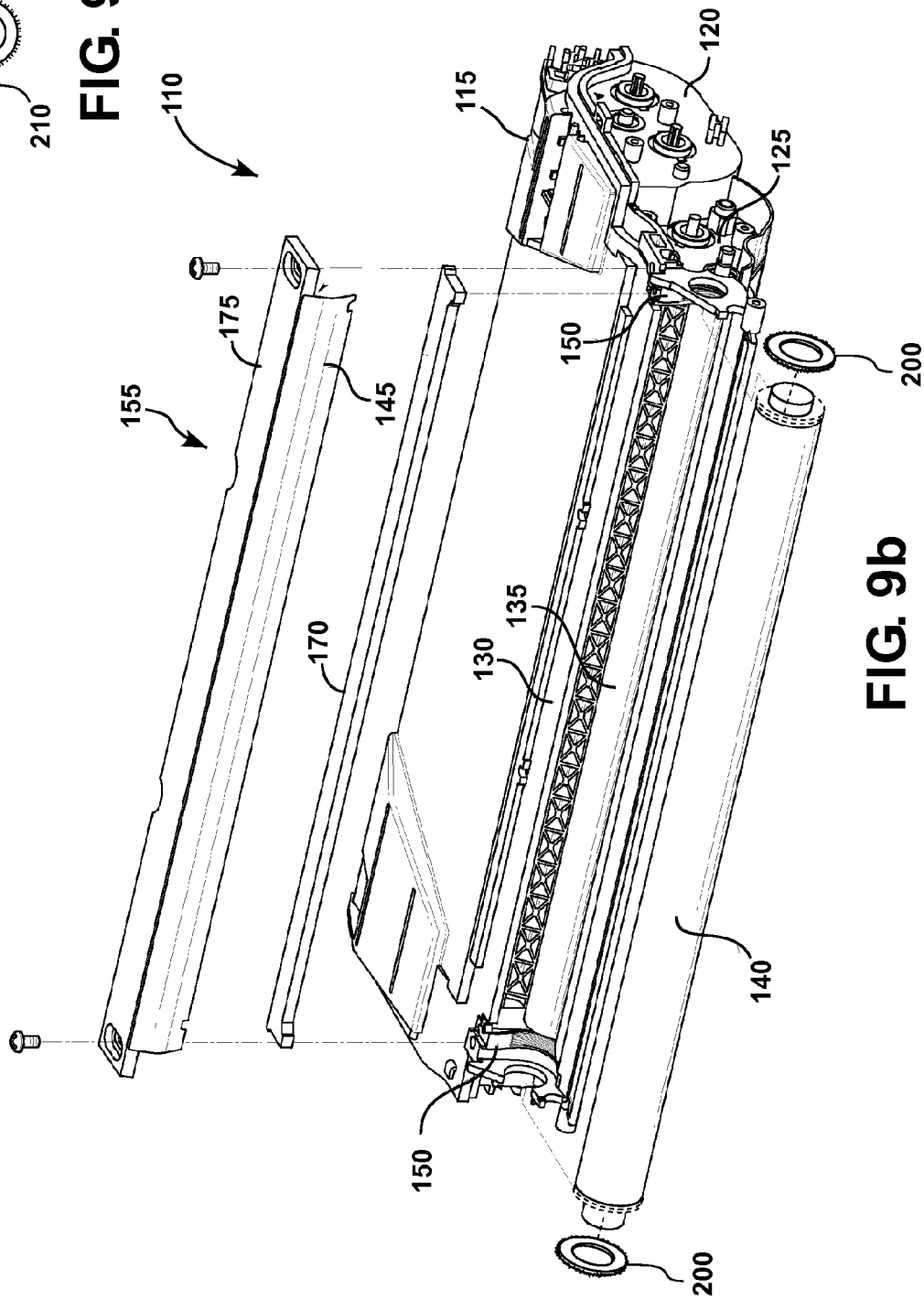
Figure 9C:
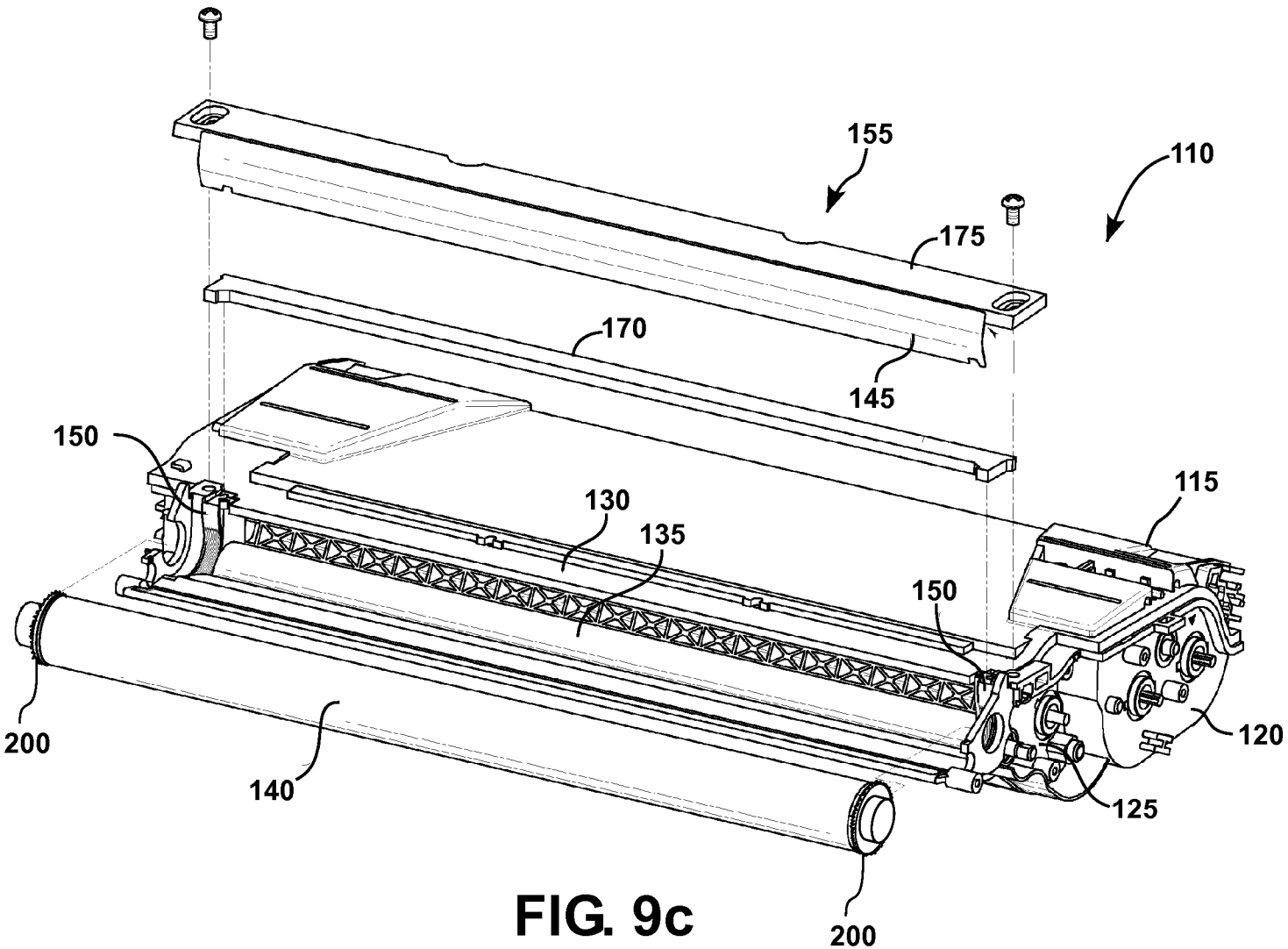

In another exemplary embodiment according to the present applications, a material 200 as shown in FIG. 9*a* may be placed on one or both sides of the developing roller 140 as shown in FIG. 9*b-c* in an effort to minimize leakage of toner between the seal(s) 150 and the developing roller 140. Although the material 200 is shown as being round, it should be clear that the material 200 may be implemented in other shapes like, for example, substantially round, partially round, oval, and/or any other shape that would minimize leakage of toner between the seal(s) 150 and the developing roller 140. In one exemplary embodiment, the material 200 may include one or more fibers 210 extending from the outer edge of the material 200 as shown in FIGS. 9*a-c*.

Figure 10A:
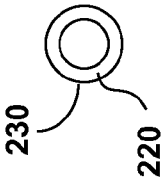
FIGS. 10*a-c* depict additional exemplary materials according to the present application.
Figure 10B:
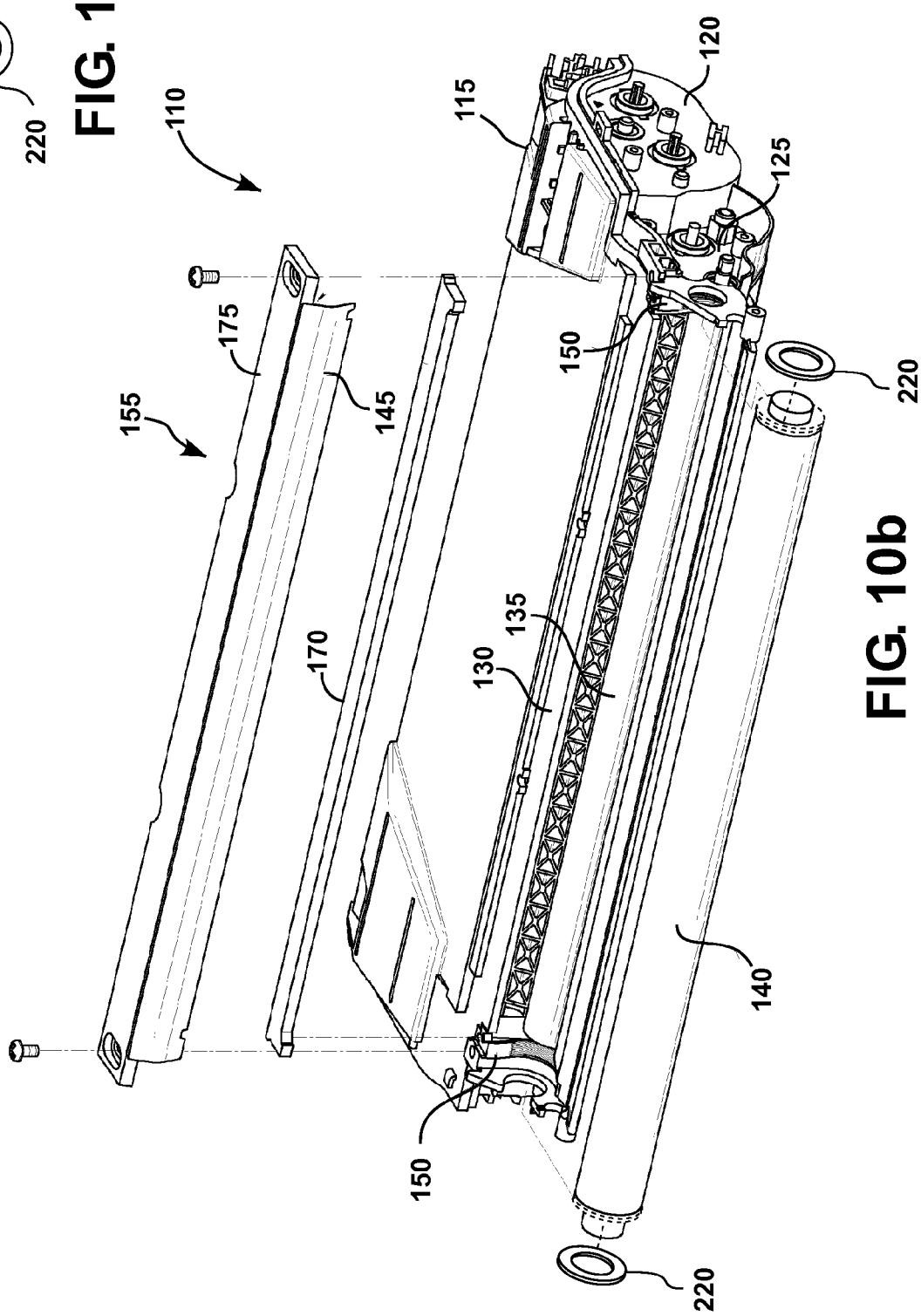
Figure 10C:
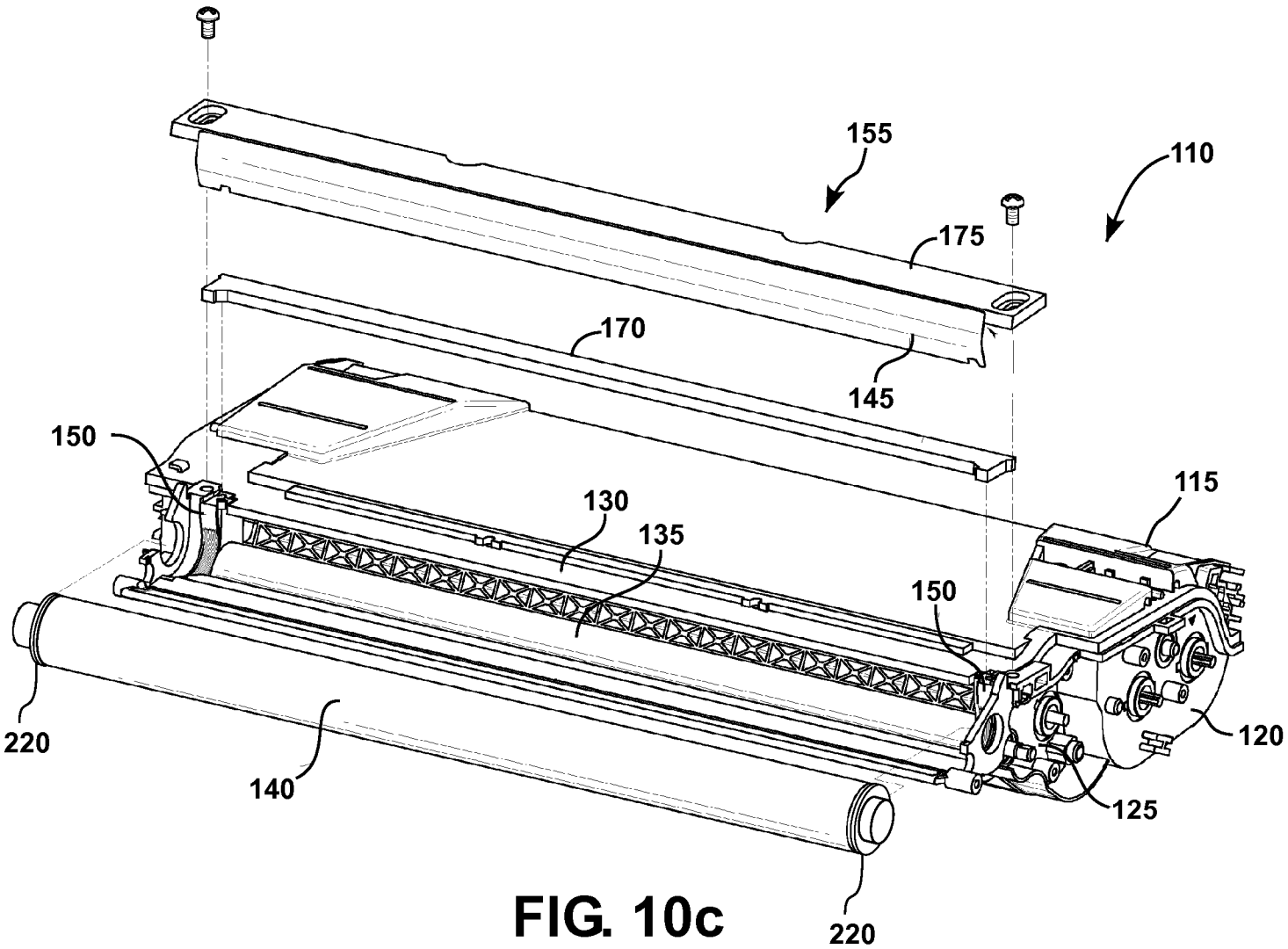

In another exemplary embodiment according to the present applications, a material 220 as shown in FIG. 10*a* may be placed on one or both sides of the developing roller 140 as shown in FIG. 10*b-c* in an effort to minimize leakage of toner between the seal(s) 150 and the developing roller 140. Although the material 220 is shown as being round, it should be clear that the material 200 may be implemented in other shapes like, for example, substantially round, partially round, oval, and/or any other shape that would minimize leakage of toner between the seal(s) 150 and the developing roller 140. In one exemplary embodiment, the material 220 may have a smooth outer edge 230 as shown in FIGS. 10*a-c*.

In one exemplary embodiment according to the present application, the materials 200 and/or 220 may be placed on one or both sides of the developing roller 140 during remanufacturing of the developer assembly 110. In one exemplary embodiment according to the present application, the materials 200 and/or 220 may be placed on one or both sides of the developing roller 140 during original manufacturing of the developer assembly 110.

The materials 200 and/or 220 may comprise woolen felt or PTFE pile, or a foamed material such as polyurethane foam, or sponge rubber, or silicone.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . . "

What is claimed is:

1. A remanufactured developer device comprising:

a previously used roller;

a previously used housing configured to accommodate the roller;

at least one previously used seal comprising a first material, wherein the at least one seal is disposed between the roller and the housing; and at least one previously unused second material positioned under the seal between the seal and the housing during remanufacturing of the developer assembly.

2. The device of claim 1, further comprising:

a developer, wherein the at least one second material is configured to minimize leakage of the developer between the at least one seal and the roller.

3. The device of claim 1, wherein the at least one second material comprises woolen felt, a PTFE pile, polymeric material, metal, silicone or a foamed material.

4. The device of claim 3, wherein the foamed material comprises a polyurethane foam or sponge rubber.

5. A method of remanufacturing a developer assembly, the method comprising:

providing a previously used developer housing;

refilling the housing with toner;

installing at least one previously used seal member within the housing;

installing a previously used roller within the housing; and, positioning at least one previously unused material under the seal between the seal and the housing to minimize leakage of the toner between the at least one seal and the roller.

6. The method of claim 5, wherein the at least one material comprises woolen felt, a PTFE pile, polymeric material, metal, silicone or a foamed material.

7. The method of claim 6, wherein the foamed material comprises a polyurethane foam or sponge rubber.

* * * * *

UNITED STATES PATENT AND TRADEMARK OFFICE

CERTIFICATE OF CORRECTION

PATENT NO. : 9,063,456 B2
APPLICATION NO. : 13/491215
DATED : June 23, 2015
INVENTOR(S) : Carlos Gutierrez and Jesus Gonzalez It is certified that error appears in the above-identified patent and that said Letters Patent is hereby corrected as shown below:

In the specification

Column 1, line 12, “know” should be changed to --known--; line 55, “the roller 6 may referred” should be changed to --the roller 6 may be referred--.
Column 2, line 1, “the blade 7 may referred to” should be changed to --the blade 7 may be referred to--; line 30, “doted lines” should be changed to --dotted lines--.
Column 3, line 15, “depicts partially exploded” should be changed to --depicts a partially exploded--; line 51, “A toner adder roll 135” should be changed to --A toner adder roller 135--; line 53, “The toner adder roll 135” should be changed to --The toner adder roller 135--.
Column 4, line 5, “the toner adder roll 135” should be changed to --the toner adder roller 135--; line 11, “the toner adder roll” should be changed to --the toner adder roller--.

Signed and Sealed this
Fifteenth Day of December, 2015

Michelle K. Lee

Michelle K. Lee
*Director of the United States Patent and Trademark Office*